US006593537B2

(12) United States Patent
Teruyama et al.

(10) Patent No.: US 6,593,537 B2
(45) Date of Patent: Jul. 15, 2003

(54) MEMBRANE SWITCH

(75) Inventors: Shuji Teruyama, Fukuoka (JP); Kazunori Hamasaki, Fukuoka (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 3 days.

(21) Appl. No.: 10/018,420

(22) PCT Filed: Apr. 17, 2001

(86) PCT No.: PCT/JP01/03279

§ 371 (c)(1),
(2), (4) Date: Dec. 13, 2001

(87) PCT Pub. No.: WO01/80263

PCT Pub. Date: Oct. 25, 2001

(65) Prior Publication Data

US 2002/0157934 A1 Oct. 31, 2002

(30) Foreign Application Priority Data

Apr. 18, 2000 (JP) ..... 2000-116840

(51) Int. Cl.[7] ..... H01H 5/00

(52) U.S. Cl. ..... 200/515; 200/406; 200/512; 200/513

(58) Field of Search ..... 200/406, 512–517

(56) References Cited

U.S. PATENT DOCUMENTS

| | | | | |
|---|---|---|---|---|
| 4,046,981 A | * | 9/1977 | Johnson et al. | 200/515 |
| 4,525,606 A | * | 6/1985 | Sado | 200/5 A |
| 4,689,879 A | | 9/1987 | Fowler | 29/622 |
| 5,286,937 A | | 2/1994 | Santo et al. | 206/516 |
| 5,401,922 A | * | 3/1995 | Asta | 200/5 A |
| 5,924,555 A | * | 7/1999 | Sadamori et al. | 200/512 |

FOREIGN PATENT DOCUMENTS

| | | | |
|---|---|---|---|
| JP | 5963930 | 4/1984 | H01H/13/70 |
| JP | 1179629 | 11/1986 | H01H/13/70 |
| JP | 23620 | 1/1990 | H01H/13/70 |
| JP | 3141522 | 6/1991 | H01H/13/70 |
| JP | 5298960 | 11/1993 | H01H/13/70 |
| JP | 0233141 | 9/1998 | H01H/13/52 |
| JP | 2590617 | 12/1998 | H01H/13/70 |
| JP | 1137028 | 9/2001 | H01H/13/70 |

OTHER PUBLICATIONS

English abstract of JP03–141522, Jun. 17, 1991.
English abstract of JP10–233141, Sep. 2, 1998.
English abstract of JP05–298960, Nov. 12, 1993.

* cited by examiner

*Primary Examiner*—Michael Friedhofer
(74) *Attorney, Agent, or Firm*—Ladas & Parry

(57) ABSTRACT

A membrane switch fixes click springs at fixed positions and largely reduces the damage caused by dust and moisture affecting contact points. The membrane switch includes fixed contact points on a circuit board made from a film of resin material such as polyester. A movable contact point member is made of semi-spherical metal click spring touching the contact points. An insulation sheet is adhered to the circuit board including the click spring, characterized by a continuous air path connected to a portion of the click spring, which is formed as a portion where no adhesive material is placed, between the insulating sheet adhered to the top face of the click spring. The continuous air path is connected to the openings formed between an edge of the insulation sheet and an edge of the circuit board.

3 Claims, 4 Drawing Sheets

MEMBRANE SWITCH

FIELD OF TECHNOLOGY

The present invention generally relates to a membrane switch, and more particularly, to a membrane switch having a hemispherical metal click spring.

TECHNOLOGY BACKGROUND

An example of conventional membrane switch of this kind is described with reference to FIG. 5 and FIG. 6.

As shown in the figures, a membrane switch 1 includes a circuit board 2, a center fixed contact point 3 and side fixed contact points 4 provided on the circuit board 2, a click spring 5, and an insulation sheet 7, adhered on the circuit board 2, with the top face of the click spring 5 included thereunder, with adhesive material 6.

The circuit board 2 is made of a film such as polyester. The center fixed contact point 3 is provided at the center of the circuit board 2, and the side fixed contact point 4 having an almost round shape is provided in the surrounding area around the center fixed contact point 4. The click spring 5 is made of hemispherical metal, and operates as a movable contact. This click spring 5 is provided so that its bottom peripheral portion is attached to the side fixed contact point 4, and its center portion touches the top face of the center fixed contact point 3.

Furthermore, the insulation sheet 7 is adhered on the circuit board 2 with adhesive material 6. Since the insulation sheet 7 is also adhered on the click spring 5 with adhesive material 6, the click spring is stationed not to slip.

Accordingly, by pressing a key top (not shown) positioned on top of nearly-center portion of the click spring 5, the insulation sheet 7 and the click spring 5 are pushed downward. The center portion of the click spring serving as a movable contact touches the center fixed contact point 3, and conducts electricity between the center fixed contact point 3 and the side fixed contact point 4.

The abovementioned click spring 5 is stationed not to slip by adhesion of the insulation sheet 7. As shown in FIG. 5 and FIG. 6, a nearly-round air bleeder hole 8 is provided to the insulation sheet 7 by opening an edge of the click spring 5 in order to release air when the click spring 5 is pressed.

The air bleeder hole 8 provided to the membrane switch 1 according to the conventional example described above is provided in a way a portion of the click spring 5 is exposed. It has been a problem that, because the air bleeding hole 8 is close to the fixed contact points 3 and 4, dust and moisture are easy to enter, and the function as a membrane switch is lowered.

DISCLOSURE OF THE INVENTION

The present invention is made to solve the technical problem described above. It is the object of the present invention to lower, under the configuration in which the click spring is stationed at a fixed position, the bad effect caused by the dust and the moisture entering through the air bleeding hole of the abovementioned conventional example.

The present invention is made to achieve the above object. A membrane switch relative to the present invention includes fixed contact points on a circuit board made of a film of resin material, movable contact point member made of semi-spherical metal click spring touching said contact points, and an insulating sheet adhered on said circuit board with said click spring inclusive, characterized by a continuous air path connected to a portion of said click spring, formed as a portion where no adhesive material is placed, between said insulating material adhered on a top face of said click spring and said click spring, and said continuous air path is connected to openings formed between an edge of said insulation sheet and an edge of said circuit board.

The membrane switch is characterized by said openings are located on both edge opposite to each other of said circuit board, and said continuous air path formed with a stripe pattern reaches to said openings on both edge opposite to each other. The membrane switch is further characterized by said continuous air path is formed by adhering said insulation sheet to said circuit board with a top face of said click spring inclusive with a spot pattern, and said continuous air path is connected to said openings. The membrane switch is yet further characterized by said continuous air path is formed by adhering said insulation sheet to said circuit board with a top face of said click spring inclusive with a matrix pattern, and said continuous air path is connected to said openings.

MOST PREFERRED EMBODIMENT OF THE PRESENT INVENTION

Figure 1:
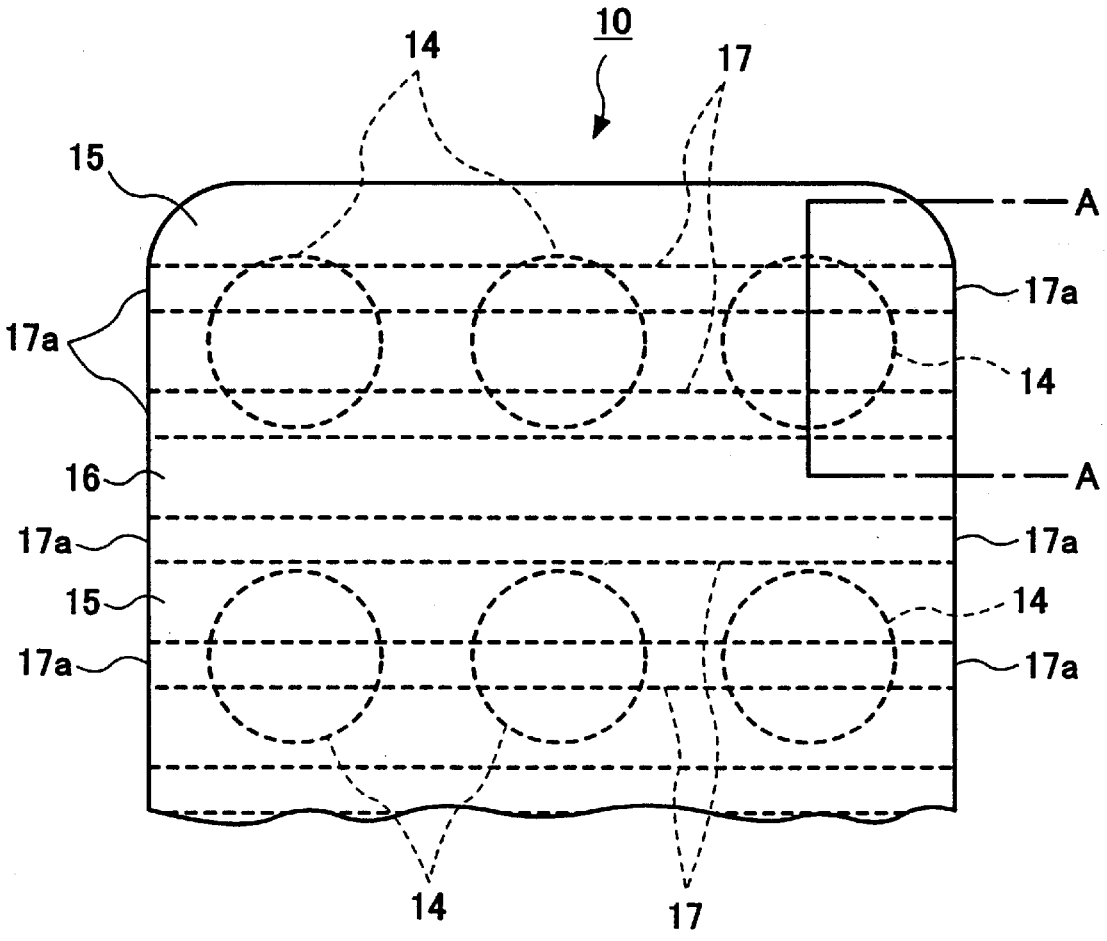
FIG. 1 is a cutout top view to describe an embodiment of the membrane switch relative to the present invention.

A description of preferred embodiments of the present invention will be given below with reference to FIG. 1 through FIG. 4.

In FIG. 1 through FIG. 4, a numeral 10 indicates the membrane switch relative to the present invention. This membrane switch 10, like the conventional example, includes a circuit board 11 made of a resin film such as polyester, a center fixed contact point 12 and a side fixed contact point 13 provided on the circuit board 11, a hemispherical metal click spring 14 which serves as a movable contact point, and an insulation sheet 16 adhered with a adhesive material 15 to the circuit board 11, with the top face of the click spring 14 included thereunder.

The hemi-spherical metal click spring 14 is provided in a way its bottom peripheral edge is attached to the side fixed contact point 13, and its center is positioned over the top face of the center fixed contact point 12. By adhering the insulation sheet 16 to the click spring 14 using the adhesive material 15, the click spring 14 is stationed not to slip.

As to the membrane switch 10 relative to the present invention, by pressing the nearly-center portion of the click spring 14, the center portion of the click spring 14 is reversed to touch the center fixed contact point 12, and conducts electricity between the center fixed contact point 12 and the side fixed contact point 13. When the action pressing the click spring 14 is released, the center portion of the click spring 14 returns to the original position by an elastic restoring force.

When the click spring 14 is pressed, it is necessary to release the air stagnating around the abovementioned fixed contact points 12 and 13 to make the switching operation smooth.

In the embodiment shown in FIG. 1, adhesive material 15 is placed on a circuit board 11 and click springs 14, 14, . . . , with a stripe pattern in order to form a linear continuous air path stretching right and left with an insulation sheet 16 adhered on the circuit board 11. The continuous air paths 17, 17, . . . , are connected to openings 17*a*, 17*a*, . . . , in non-adhered portions formed on the right and left edges of the circuit board 11 and the insulation sheet 16.

Figure 2:
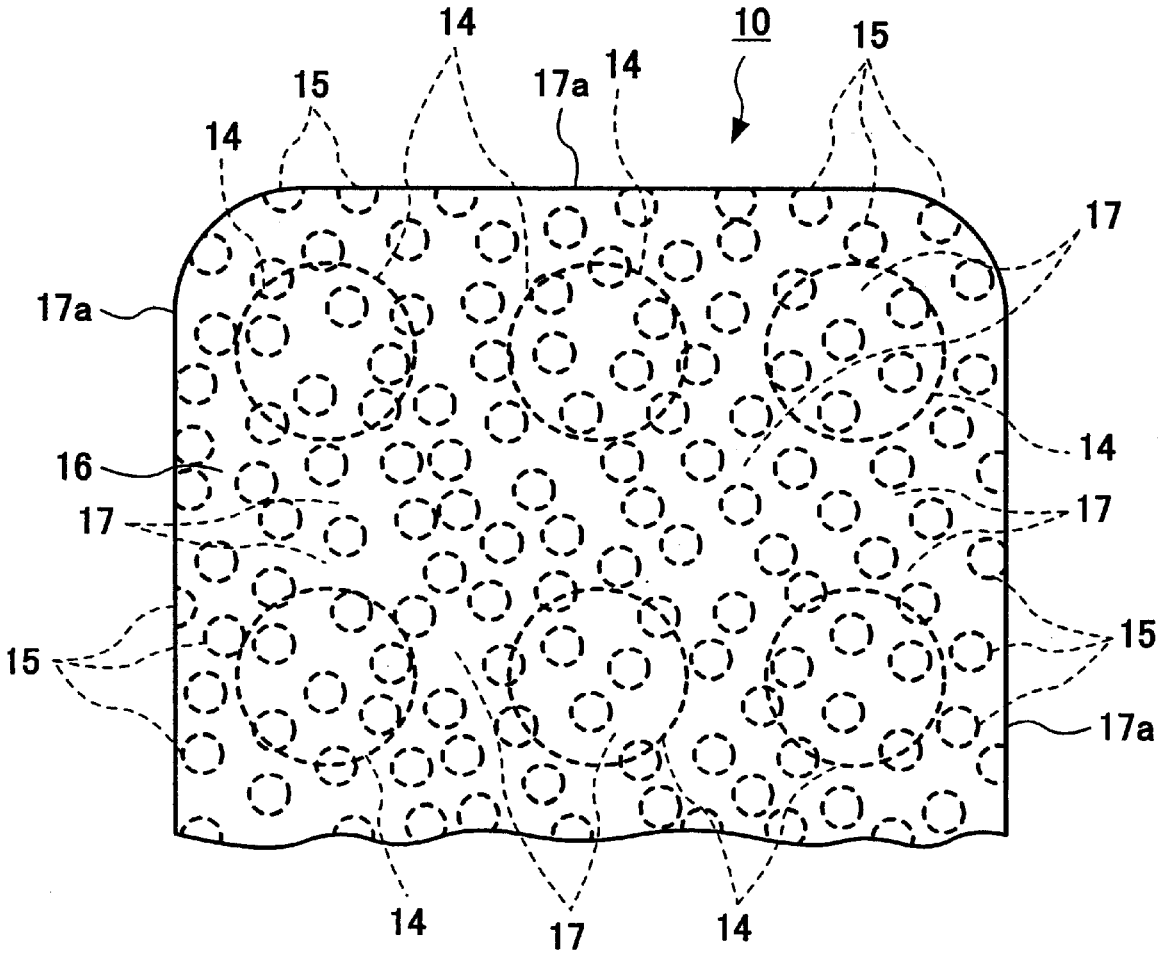
FIG. 2 is a cutout top view to describe another embodiment of the membrane switch relative to the present invention.

In the embodiment shown in FIG. 2, the adhesive material 15, 15, . . . , is placed on the circuit board 11 and on the top face of the click springs 14, 14, . . . , with a spot pattern, and adheres the insulation sheet 16 on the circuit board 11 and the click springs 14, 14, . . . . Accordingly, the continuous air path 17, including the portions of the click springs 14, 14, . . . , is formed by non-adhered portions with a spot pattern between the circuit board 11 and the insulation sheet 16, and is connected to the openings 17*a*, 17*a*, . . . , in non-adhered portions formed on the edges of the circuit board 11 and the insulation sheet 16.

Figure 3:
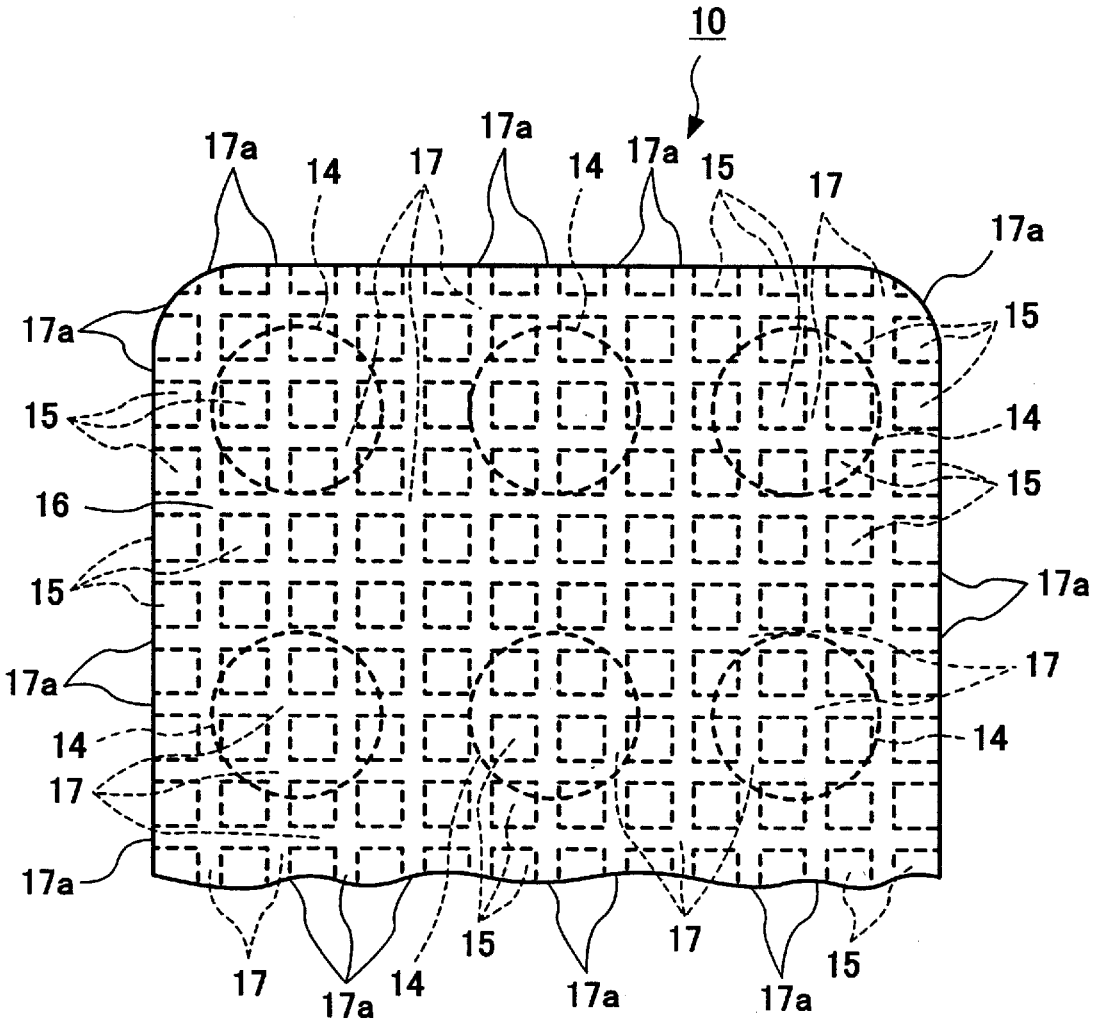
FIG. 3 is a cutout top view to describe yet another embodiment of the membrane switch relative to the present invention.
Figure 4:
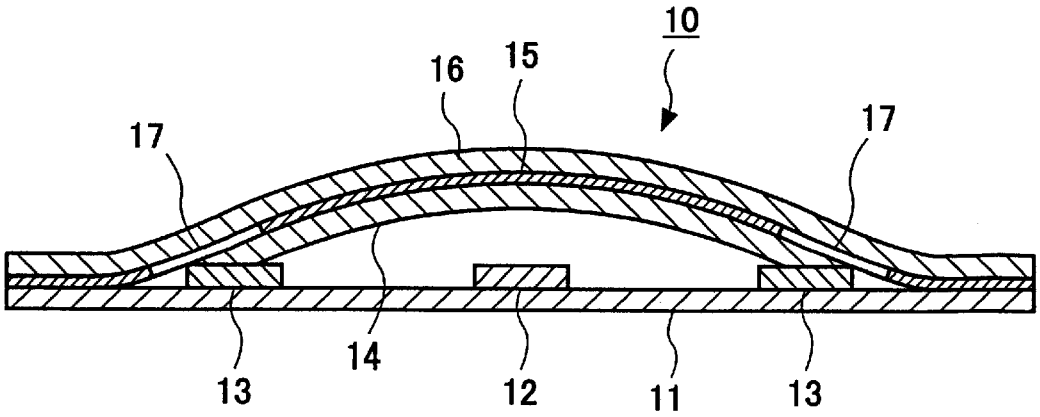
FIG. 4 is a sectional view along the A—A line of the membrane switch illustrated in FIG. 1.
Figure 5:
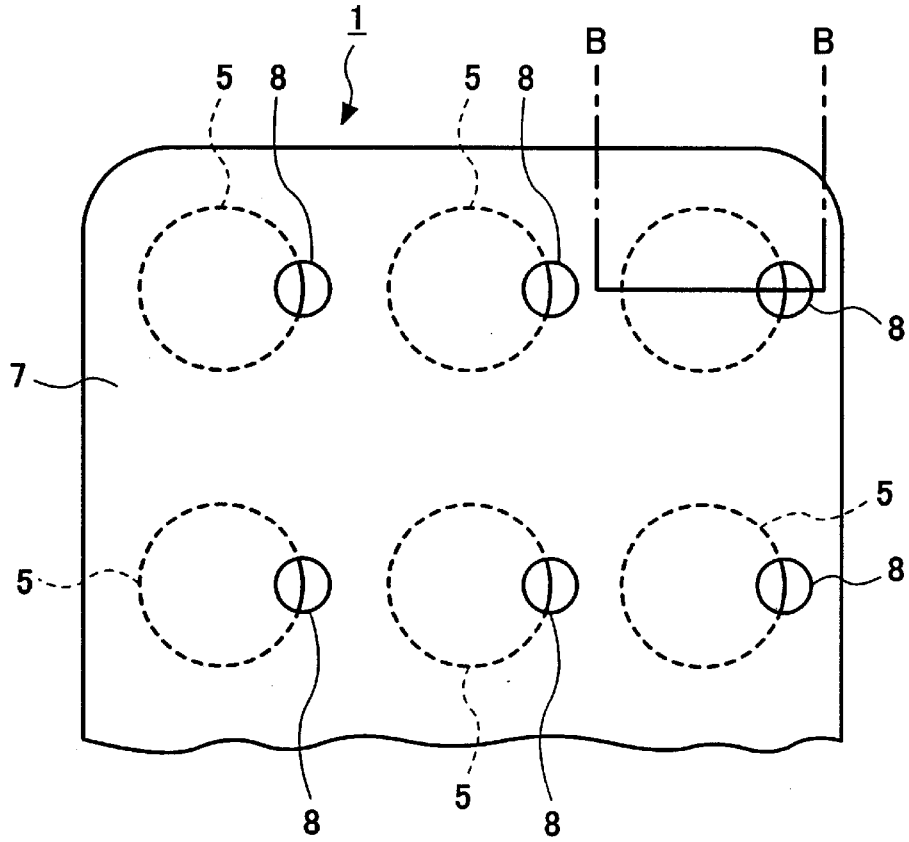
FIG.5 PRIOR ART
FIG. 5 is a cutout top view to describe a conventional membrane switch.
Figure 6:
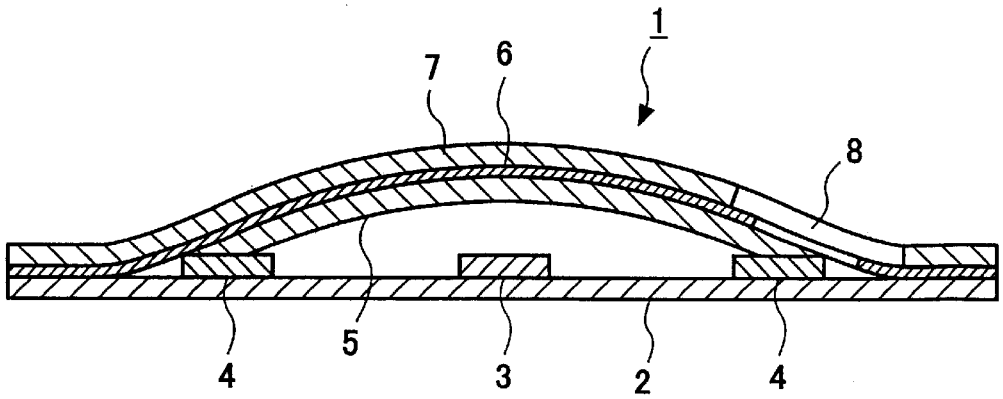
FIG.6 PRIOR ART
FIG. 6 is a sectional view along the B—B line of the membrane switch illustrated in FIG. 5.

Furthermore, in the embodiment shown in FIG. 3, the adhesive material 15, 15, . . . , is placed on the circuit board 11 with a matrix pattern, and adheres the insulation sheet 16. Accordingly, The continuous air path 17, 17, . . . , is formed by non-adhered portions with a matrix pattern, and is connected to the openings 17*a*, 17*a*, . . . , in non-adhered portions formed on the edges of the circuit board 11 and the insulation sheet 16. In other words, in these embodiments, the conventional method of adhering entire area is changed to the methods of a stripe pattern, a spot pattern, and a matrix pattern, and the continuous air path 17 is formed by non-adhered portions. Furthermore, the continuous air path 17 is connected to the openings 17*a*, 17*a*, . . . which are formed on the edge of the circuit board 11, and makes switching operation smooth by releasing air when the click springs 14, 14, . . . , are pressed.

Because the click spring 14 is, as described previously, adhered to the insulation sheet 16 by adhesive material 15, the click spring 14 is positioned properly, and does not slip. Since the openings 17*a*, 17*a*, . . . connected to the continuous air path 17 are formed on the edges of the circuit board 11, the openings 17*a*, 17*a*, . . . are far from the click springs 14, 14, . . . . Therefore, the path from the openings 17*a*, 17*a*, . . . to the fixed contact points 12 and 13 becomes long, the damage caused by dust and moisture entering from the openings 17*a*, 17*a*, . . . is largely reduced.

The present invention is not limited to these embodiments, but various variations and modifications may be made without departing from the scope of the present invention.

As described above using the embodiments of the present invention, when an insulation sheet is adhered on a circuit board, with click springs included thereunder, with adhesive material, an air path is formed using a space formed by non-adhered portions, and the air stagnating in the space of fixed contact points is released. The continuous air path is connected to openings formed in non-adhered portion on the edges of the circuit board, the openings is located far from the fixed contact points. Accordingly, the path from the openings to the fixed contact points can be made long, and dust and moisture entering through the openings can be avoided by a case in which the membrane switch is stored. Consequently, damage caused by dust and moisture entering through air bleeder holes is widely reduced. Of course, the click springs are fixed at the right positions, the adhering positions, where adhesive material is placed, on the above-mentioned insulation sheet, and can be expected to perform smooth switching. At the same time, since the adhesive material is not placed entirely, the usage of the adhesive material can be reduced, and the cost is lowered.

What is claimed is:

1. A membrane switch, including fixed contact points on a circuit board made of a film of resin material, a movable contact point member made of a semi-spherical metal click spring that touches said contact points, and an insulating sheet adhered on said circuit board with said click spring included thereunder, characterized by:

a continuous air path connected to a portion of said click spring, formed as a portion where no adhesive material is placed, between said click spring and said insulating sheet adhered on a top face of said click spring, said continuous air path is connected t openings formed between an edge of said insulation sheet and an edge of said circuit board; and said openings being located on edges opposite to each other on said circuit board, and said continuous air path formed with a stripe pattern reaching to said openings on both of the edges opposite to each other, and a pitch of said stripe pattern being shorter than a size of said movable contact point member.

2. A membrane switch, including fixed contact points on a circuit board made of a film of resin material, a movable contact point member made of a semi-spherical metal click spring that touches said contact points, and an insulating sheet adhered on said circuit board with said click spring included thereunder, characterized by:

a continuous air path connected to a portion of said click spring, formed as a portion where no adhesive material is placed, between said click spring and said insulating sheet adhered on a top face of said click spring, said continuous air path is connected to openings formed between an edge of said insulation sheet and an edge of said circuit board; and said continuous air path being formed by adhering said insulation sheet to said circuit board and a top face of said click spring with a spot pattern, and said continuous air path being connected to said openings, and a distance of a spot to another spot being shorter than a size of said movable contact point member.

3. A membrane switch, including fixed contact points on a circuit board made of a film of resin material, a movable contact point member made of a semi-spherical metal click spring that touches said contact points, and an insulating sheet adhered on said circuit board with said click spring included thereunder, characterized by:

a continuous air path connected to a portion of said click spring, formed as a portion where no adhesive material is placed, between said click spring and said insulating sheet adhered on a top face of said click spring, said continuous air path is connected to openings formed between an edge of said insulation sheet and an edge of said circuit board; and said continuous air path being formed by adhering said insulation sheet to said circuit board and a top face of said click spring with a matrix pattern, and said continuous air path being connected to said openings, and a pitch of said matrix pattern is shorter than a size of said movable contact point member.

* * * * *